United States Patent [19]

Taylor, Jr. et al.

[11] Patent Number: 4,584,543

[45] Date of Patent: Apr. 22, 1986

[54] RADIO FREQUENCY SWITCHING SYSTEM USING PIN DIODES AND QUARTER-WAVE TRANSFORMERS

[75] Inventors: Taliaferro H. Taylor, Jr., Louisville; Robert T. Johnk, Arvada; Clifton W. Garvin, Longmont, all of Colo.

[73] Assignee: Ball Corporation, Muncie, Ind.

[21] Appl. No.: 586,621

[22] Filed: Mar. 6, 1984

[51] Int. Cl.[4] ..... H01P 1/15

[52] U.S. Cl. ..... 333/103; 333/104; 333/128

[58] Field of Search ..... 333/104, 103, 101, 125, 333/127, 128, 246, 262, 247; 328/103-105

[56] References Cited

U.S. PATENT DOCUMENTS

| | | | |
|---|---|---|---|
| 3,223,947 | 12/1965 | Clar | 333/104 |
| 3,474,358 | 10/1969 | Geddry et al. | 333/103 |
| 4,127,830 | 11/1978 | Chalifour et al. | 333/104 |
| 4,267,538 | 5/1981 | Assal et al. | 333/246 X |
| 4,302,734 | 11/1981 | Stockton et al. | 333/104 |

FOREIGN PATENT DOCUMENTS

| | | | |
|---|---|---|---|
| 7328507 | 2/1975 | France | 328/104 |
| 2484715 | 12/1981 | France | 333/127 |

OTHER PUBLICATIONS

Peterson, Dean; "Radial-Symmetric N-Way TEM Line INPATT Diode Power Combining Arrays"; *IEEE Transaction on Microwave Theory & Technique;* vol. MTBO, No. 2, Feb. 1982; pp. 163-172.

Product Feature; "Solid State Multi Throw Switches 2-18 Ghz" *General Microwave Corporation;* Farmindale N.Y.; 7/1971 Microwave Journal, p. 22.

*Primary Examiner*—Eugene R. LaRoche

*Assistant Examiner*—Benny T. Lee

*Attorney, Agent, or Firm*—Gilbert E. Alberding

[57] ABSTRACT

This invention allows the combination of any M of N signal inputs, combines the signals inputs in phase, and does not require switches to terminate unused inputs.

Microstrip switching means provide an array of N quarter-wave tuners and an associated single, common, quarter-wave tuner that are interconnected by N semiconductor switching means. Each of the N semiconductor switches is connected with one of the N quarter-wave tuners and is operable to provide a low impedance between its connected quarter-wave tuner and the single common quarter-wave tuner.

Microstrip connecting means for the microstrip switching means forms an array of N transmission lines N associated quarter-wave transformers for semiconductor switch biasing and a single transmission line. Each of the N transmission lines and its associated one of the N bias quarter-wave transformers are connected together at one end and further connected with one of the N quarter-wave transformers of the microstrip switching means and has an RF connection at its other end. The single transmission line is connected at one end with the single common integral quarter-wave transformer of the microstrip switching means and has an RF connection at its other end.

Electrical current through any M of the N bias quarter-wave tuners and the connected M quarter-wave and semiconductor switches can be used to electrically connect the M quarter-wave tuners with the single common quarter-wave tuner, permitting signals on the M quarter-wave tuners to be combined in phase of the common quarter-wave tuner output.

10 Claims, 3 Drawing Figures

RADIO FREQUENCY SWITCHING SYSTEM USING PIN DIODES AND QUARTER-WAVE TRANSFORMERS

This invention relates to a system to allow the combination of RF power from any M of N inputs in a common output or to split RF power from a common input into M of N outputs, and more particularly relates to a system permitting microstrip techniques to be used in the combination and division of RF power and avoiding problems associated with the geometrically asymmetrical location of the plurality of M inputs and outputs with regard to the common output or input.

BACKGROUND OF THE INVENTION

Known devices to combine RF power include two general classifications. The first class includes radial cavity wave-guides switches, and the second class includes diode switch matrices. The performance of radial cavity wave-guide switches is dependent upon the geometric location of the outputs and inputs with respect to the cavity. The performance of such radial cavity wave-guide power dividers was not satisfactory with asymmetrical arrangements of outputs about the switch. Prior diode switching matrices used, typically, PIN diodes or FET devices to control the flow of energy based on the application of a bias current. Such switching systems, however, have proved to be unsatisfactory where more than a few inputs were needed.

SUMMARY OF THE INVENTION

This invention allows the combination of a large number of signal inputs even though they may be asymmetrically associated with the output, combines the signal inputs in phase, and does not require switches to terminate unused inputs. The invention also permits the effective division of power from a single common input among a large number of asymmetrically located outputs. The invention permits a smaller device which uses less power. To simplify further description of the invention, the invention will be discussed in its application to combine any M of N inputs.

The invention comprises an array of N impedance-matching devices and an associated single impedance-matching device that are interconnected by N semiconductor switching means. Each of the N semiconductor switches is connected with one of the N impedance-matching devices and is operable to provide a low impedance between its connected impedance-matching device and the single impedance-matching device. The application of biasing current to any M of the N semiconductor switches can be used to electrically connect any M of the N impedance-matching device with the single, common, impedance-matching device, permitting signals through the M impedance-matching devices to be combined in phase through the common impedance-matching device.

In its preferable embodiment, microstrip techniques are used to provide the switching means for a plurality of high-frequency signals. A dielectric substrate and associated conductors form the plurality of impedance-matching devices, preferably as a spoke-like array of N quarter-wave transformers for the high-frequency signals, each of the N quarter-wave transformers preferably having the same characteristic impedance. The substrate of the microstrip switching means further has a single conductor on its surface to form the single impedance-matching device, preferably as a hub-like portion centrally located adjacent to the inner ends of the spoke-line array of N quarter-wave transformers and a single, integral, spoke-like portion extending outwardly from the hub-like portion to form a quarter-wave transformer having a second characteristic impedance. The dielectric substrate carries the semi-conductor switches, preferably N PIN diodes, connected between the inner ends of the N quarter-wave transformers and the central, hub-like portion of the single conductor, thereby permitting the semiconductor switches to control the transfer of high-frequency energy from the N quarter-wave transformers to the common, integral, quarter-wave transformer of the single conductor.

Microstrip techniques can also be used to form a connecting means. A printed wiring board can form a spoke-like array of N transmission lines, each of the N transmission lines being connected at its inner end with the outer end of one of the N quarter-wave transformers of the microstrip switching means and being connected at its outer end with means forming an RF connection; e.g., an RF connector carried by the printed wiring board. The printed wiring board can further form a single transmission line that is connected at its inner end with the single, common, integral, quarter-wave transformer of the microstrip switching means and is connected at its outer end with means, such as a single RF connector, forming an RF connection. The printed wiring board also forms a further spoke-like array of N quarter-wave transformers for the biasing circuits, each of the N biasing quarter-wave transformers being connected at its inner end with the inner end of one of the N spoke-like transmission lines and at its outer end with a source of electric current.

The application of electrical potential to the outer ends of any M of the N biasing quarter-wave transformers and a resulting current flow through the associated M semiconductor switches reduces the electrical impedance of the M semiconductor switches so that RF energy on the M associated transmission lines may be transmitted through the M quarter-wave transformers on the microstrip switching means to the hub-like portion for combined transmission as an output over the single, common, spoke-like, quarter-wave transformer and the single transmission line of the microstrip connecting means to its RF connection at the outer end.

As explained further below, the characteristic impedances of the quarter-wave transformers of the microstrip switching system may be designed to permit impedance matching and efficient transfer of energy through the system. The invention also permits a relatively wide, useful, bandwidth for the system and prevents the loss of microwave energy over the system used to bias and select the inputs. The invention provides a switching system which provides acceptable operations with both symmetrical and asymmetrical arrangements of inputs or outputs and is a substantial improvement over the cavity-type, power-switching system, an interconnection method which is not acceptable with asymmetrical inputs and loading. Improved performance and a compact, relatively easily manufactured and inexpensive system can be obtained with the invention and microstrip techniques; and the invention permits the input and output impedances to be the same notwithstanding the selection of an M of N inputs.

Further features and advantages of this invention would be apparent from the following description of a preferred embodiment and the figures in which:

DETAILED DESCRIPTION OF THE PREFERRED EMBODIMENT

Figure 1:
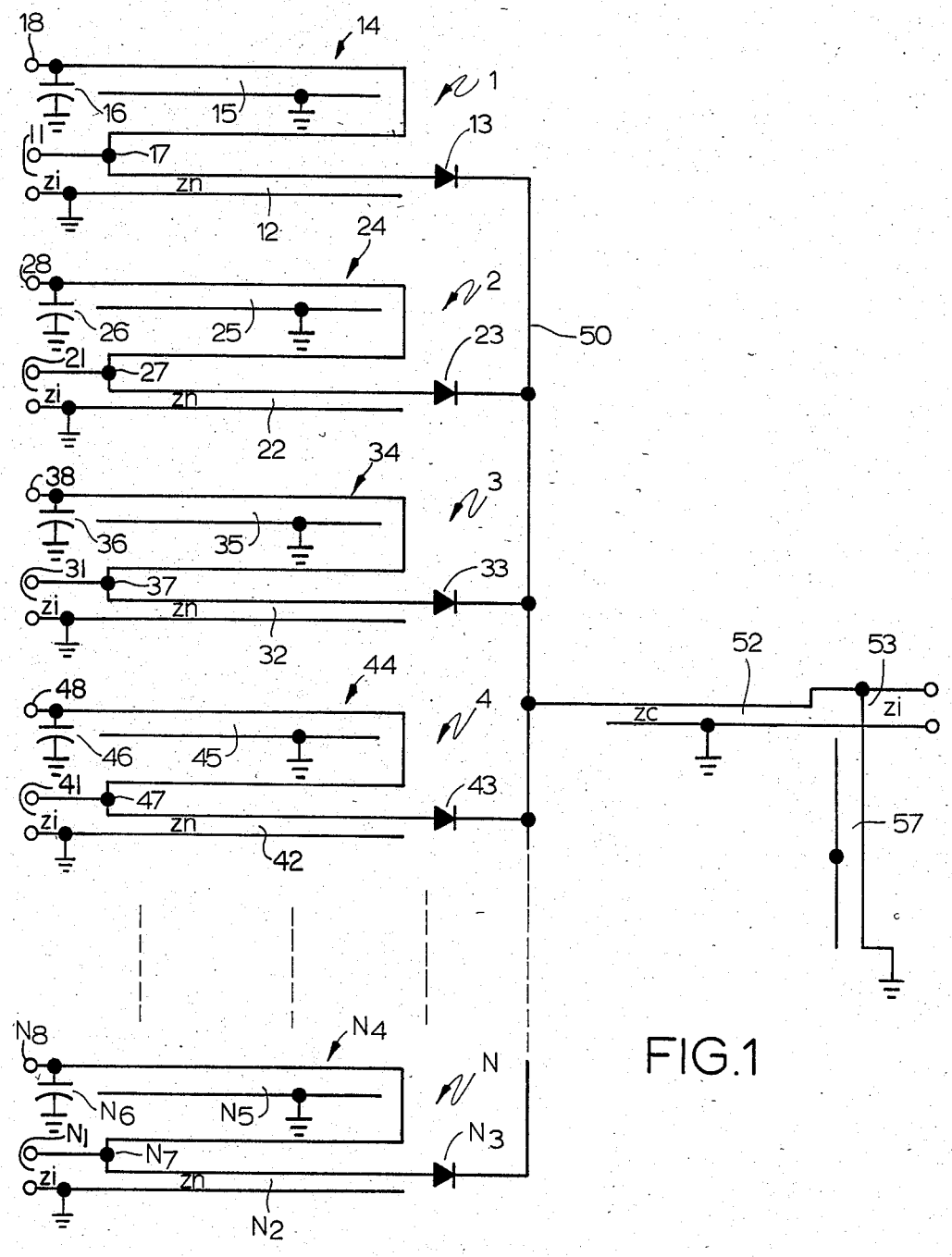
FIG. 1 shows diagrammatically an equivalent electrical circuit of the system of this invention.

FIG. 1 is an equivalent electrical diagram for the preferred system of this invention. In the equivalent diagram of FIG. 1, the system 100 of this invention is illustrated as having a plurality of N inputs 1, 2, 3, 4 . . . N. Each of the N inputs includes a transmission line 11, 21, 31, 41 . . . $N_1$ and a quarter-wave transformer 12, 22, 32, 42 . . . $N_2$; a semiconducting switching device 13, 23, 33, 43 . . . $N_3$; and a biasing system for the semiconducting switching means 14, 24, 34, 44 . . . $N_4$. Each of the N biasing means includes a quarter-wave transformer 15, 25, 35, 45 . . . $N_5$, and a RF shorting capacitor 16, 26, 36, 46 . . . $N_6$. Each of the N bias quarter-wave transformers 15, 25, 35, 45 . . . $N_5$ is connected with its associated transmission line 11, 21, 31, 41 . . . $N_1$ (for example, at 17, 27, 37, 47 . . . $N_7$). The N inputs 1, 2, 3, 4 . . . N are connected through the semiconducting switching means 13, 23, 33, 43 . . . $N_3$ to a common conductor 50. The common conductor 50 is connected with a single quarter-wave transformer 52 that is, in turn, connected with a transmission line 53. The bias circuit for the semiconductor switches 13, 23, 33, 43 . . . $N_3$ is completed through quarter-wave transformer 57 which is connected to transmission line 53 at one end and grounded at the other end. In the preferred system of the invention, the transmission lines 11, 21, 31, 41 . . . $N_1$ and the transmission line 53 all have preferably the same characteristic impedance $Z_i$; but the characteristic impedances may be varied if desirable.

The characteristic impedances $Z_N$ of quarter-wave transformers 12, 22, 32, 42 . . . $N_2$ and the characteristic impedance $Z_c$ of quarter-wave transformer 52, are adjusted in the system for impedance matching between M of the N inputs and the single output. For example, where four of the N inputs will be combined in the single output 53 and where the characteristic impedance of the transmission lines 11, 21, 31, 41 . . . $N_1$ and the transmission line 53 are 50 ohms, the characteristic impedances $Z_N$ and $Z_c$ may be determined as follows:

If the effective impedance E of the input circuits 1, 2, 3, 4 . . . N is equal to 100 ohms, then the characteristic impedance $Z_N$ would equal the square root of $Z_i \times E = \sqrt{Z_i E} = \sqrt{50 \times 100} = 70.7$ ohms.

Because four inputs are combined in this example, the effective impedance 51 between the common line 50 and ground would appear to be $$E/M = 100/4 = 25 \text{ ohms.}$$

The characteristic impedance $Z_c$ of the quarter-wave tuner 52 would be the square root of E divided by $M \times Z_i$, or $Z_c = \sqrt{25 \times 50} = 35.35$ ohms.

Although for sake of clarity, inputs 5 through N-1 have been omitted from FIG. 1. Any M, in this case four, of the N inputs may be combined in the operation of the system with impedance matching between the inputs and outputs with the input and output impedances equal. In addition, quarter-wave transformers are used in the preferred embodiment of the invention because of the ease with which they may be incorporated into the system with microstrip techniques. In the broader sense of the invention, other impedance-matching devices and circuits may be used, for example, multiple lengths of transmission line can be used for impedance matching with a somewhat broader bandwidth if the advantages of size and cost available with microstrip techniques are not desirable.

FIG. 1 specifically shows PIN diodes as the preferable semiconductor switching means 13, 23, 33, 43 . . . $N_3$. Other semiconducting switching means, such as FET devices, can, however, be used in the invention. The PIN diodes are operated by the application of a potential at the inputs 18, 28, 38, 48 . . . $N_8$ which will cause current flow through the quarter-wave transformers 15, 25, 35, 45 . . . $N_5$, through the N quarter-wave transformers 12, 22, 32, 42 . . . $N_2$, through the PIN diodes 13, 23, 33, 43 . . . $N_3$, and through the quarter-wave transformers 52, transmission line 53, and grounded quarter-wave transformer 57. The flow of current through any four PIN diodes, for example, 13, 23, 33, and 43, lowers their impedance substantially, permitting high-frequency energy from the four associated transmission lines 11, 21, 31, 41 to flow to and be combined in the common quarter-wave transformer 52 and transmission line 53. It is, of course, understood that any four of the diodes may be combined in operation of the system to provide an output of their signals at the common single quarter-wave transformer and transmission line.

The biasing input connections 18, 28, 38, 48 . . . $N_8$ are provided with sufficient capacity in the capacitors 16, 26, 36, 46 . . . $N_6$ to represent a short circuit at the RF frequencies handled by the system. Because of the effect of the quarter-wave transformers 15, 25, 35, 45 . . . $N_5$, the RF short circuits at the inputs 18, 28, 38, 48 . . . $N_8$ of the quarter-wave transformers are reflected at the connections to the semiconducting switching devices 13, 23, 33, 43, and $N_3$ as substantially open circuits for RF energy; and thus, no RF energy is lost through the biasing means 14, 24, 34, 44 . . . $N_4$.

Figure 2:
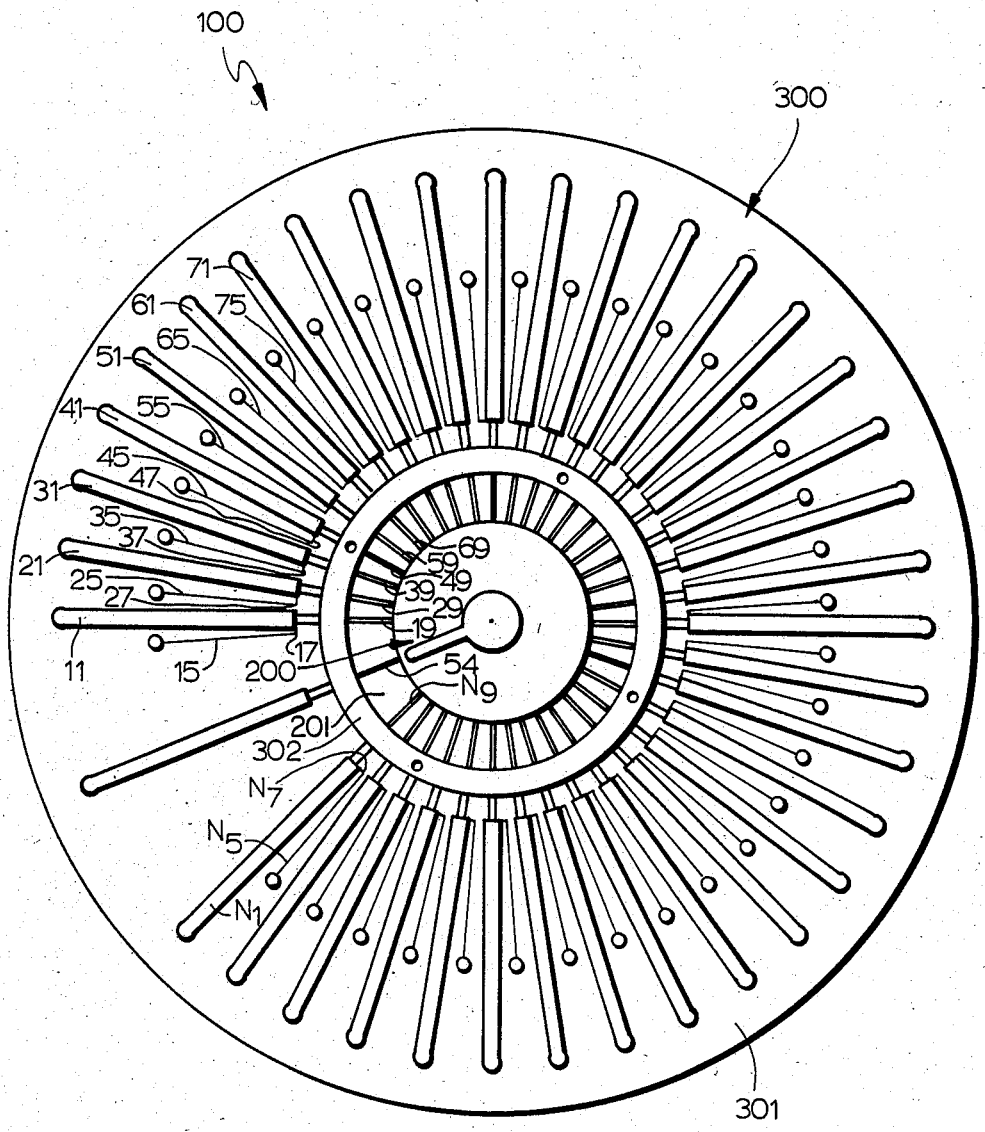
FIG. 2 is a overall view of the preferred system of this invention showing thirty-six inputs/outputs and a common associated output/input.

FIG. 2 is a drawing of a system 100 of this invention, demonstrating a preferred physical arrangement of 36 (N) input circuits and the single output circuit 52, 53. In its physical embodiment, as shown in FIG. 2, the system of this invention is comprised of generally two means: an internal microstrip switching means 200, shown in detail in FIG. 3, but not shown in FIG. 2 because of size limitations, and an outer connecting means 300 which can carry and be hermetically sealed to the internal microstrip means 200. The connecting means shown in FIG. 2 is preferably a Teflon printed wiring board 301 on which a spoke-like array of transmission lines, 11, 21, 31, 41 . . . $N_1$ (36 in the FIG. 2 embodiment) has been formed by microstrip techniques. In addition, a plurality of quarter-wave transformers 15, 25, 35, 45 . . . $N_5$ for the biasing circuits of the semiconducting switching means have also been formed in a generally spoke-like array, each biasing quarter-wave transformers 15, 25, 35, 45 . . . $N_5$ being generally adjacent and parallel to its associated transmission line 11, 21, 31, 41 . . . $N_1$. The outer ends of the transmission lines and the biasing quarter-wave transformers of the microstrip connecting means 300 may be terminated with appropriate RF connectors which are not shown in FIG. 2.

Figure 3:
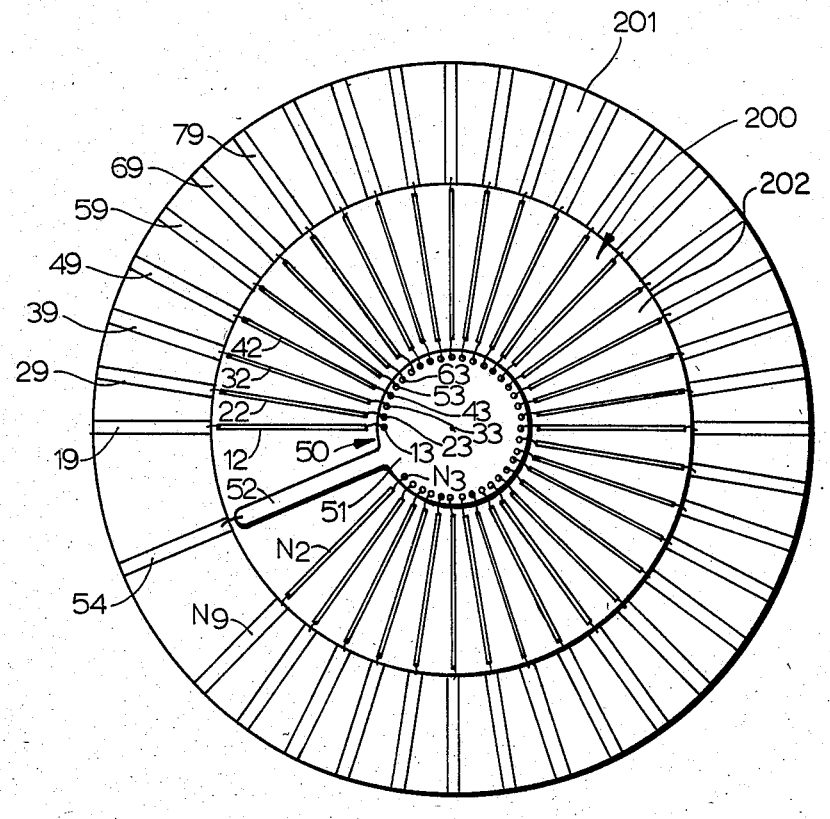
FIG. 3 is an expanded diagrammatic view of the microstrip switching means centrally located within the preferred system of FIG. 2.

An annular brass ring 302 can be attached to the printed wiring board 301 adjacent the inner ends of the spoke-like array of transmission lines and the biasing quarter-wave transformers. The annular brass ring 302 forms no part of the electrical system and is provided to carry and be hermetically sealed with the central internal microswitch means 200 in its preferred structure. An annular interconnecting ring 201 of Epsilam-10, a trademark of Rogers Corporation for dielectric substrate of ceramic-loaded polytetrafluoroethylene polymer material, provides preferably a plurality of conductors leading from the transmission lines 11-$N_1$ of the printed wiring board 301 to the quarter-wave transformers 12-$N_2$ and semiconducting switching means 13-$N_3$ of the internal microstrip means 200. The Epsilam interconnect ring 201 shown in FIGS. 2 and 3 is adapted at the surface adjacent the brass ring 302 to connect with a plurality of feedthroughs for the transmission lines 11-$N_1$. The feedthroughs may consist of short sections of the innerconductor and dielectric of a 0.085-inch, semi-rigid cable which is epoxied into the brass ring 302 or may consist of low-capacity, glass-to-metal seal feedthroughs which are soldered into place. In any event, the feedthroughs are provided in a manner known in the art and are connected at their outer ends to the plurality of transmission lines and the biasing quarter-wave transformers of connecting means 300 and at their inner means to the plurality of conductors of the Epsilam interconnect ring 201 to provide thereby the connections between the connecting means 300 and the microstrip switching means 200.

The microstrip switching means 200 shown in FIG. 3 is the heart of the invention. The microstrip switching means 200 comprises the impedance-matching devices for the systems and the semiconductor switching means permitting any M of N inputs to be combined. The microstrip switching means may be connected to the Epsilam interconnect ring by a plurality of five-milwide gold ribbons (not shown) that are welded to the conductors of the microstrip switching means and interconnecting ring as known in the art.

As shown in FIG. 2, the system can be provided with thirty-six inputs (in which case N=36) and a single output 53. As shown in FIG. 3, the connections 19, 29, 39, 49 . . . $N_9$ of Epsilam interconnect ring 201 interconnect the transmission lines 11, 21, 31, 41 . . . $N_1$ and the biasing systems 14, 24, 34, 44 . . . $N_4$ with the quarter-wave transformers 12, 22, 32, 42 . . . $N_2$ formed on substrate 202, preferably alumina, of the microstrip switching means. The N quarter-wave transformers 12, 22, 32, 42 . . . $N_2$ are formed in a spoke-like array generally around the periphery of the alumina substrate 202. A single common conductor 50 is formed with an enlarged portion 51 adjacent the arrayed ends of the quarter-wave transformers. As shown in FIG. 3, portion 51 is preferably centrally located adjacent the inner end of the quarter-wave transformers 12-$N_2$ in a hub-like configuration. The conductor 50 also forms an integal, single, outwardly extending, quarter-wave transformer 52 extending from the central hub portion 51 to adjacent the outer edge of the alumina substrate where it is interconnected to the Epsilam interconnect ring conductor 54 for interconnection with the transmission line 53 of the connecting means 300. As shown, a plurality of N PIN diodes 13, 23, 33, 43 . . . $N_3$ interconnect the inner ends of each of the quarter-wave transformers 12, 22, 32, 42 . . . $N_2$ with the central hub-like portion 51 and output quarter-wave transformer 52. The plurality of quarter-wave biasing transformers 15, 25, 35, 45 . . . $N_5$ are also thus interconnected with the PIN diodes 13, 23, 33, 43 . . . $N_3$ and can provide current to the PIN diodes to control their impedances. Forward current biasing the diodes reduces their impedance to the extent that they are substantially a short circuit. Location of the semiconductor switches at the interconnection between the common impedance-matching device 50 (and particularly its enlarged portion 51) and the N impedance-matching devices 12, 22, 32, 42 . . . $N_2$ of inputs 1, 2, 3, 4 . . . N is important in achieving effective operation and bandwidth. Back biasing the PIN diodes effectively removes them from the circuit. With the PIN diodes back biased and with their impedances a substantial open circuit, power from the M switched inputs and the common output 52 is blocked from transfer to the unused inputs. As a result, the band width of the system is substantially increased.

For a system for use with frequencies of 2000 to 2500 megahertz, RF connectors of the SMA type on the input and output leads may be used. Such connectors simplify testing and fabrication of the hardware; however, they increase the size and losses of the switching of the system. For example, if one-half-inch spacing is allowed between each of the thirty-six RF connectors at the outer ends of the plurality of transmission lines, and if one-inch spacing is allowed between the RF connector at the end of the output transmission line 53 and the closest input transmission lines (11 and $N_1$), the diameter of the connecting means 300 must be at least 6.2 inches. If a connectorless interconnection method is used, the output radius can be reduced to 4.2 inches; and as a result, 2 inches of microstrip transmission line can be removed from the system, reducing the system loss by about 0.1 dB.

In performance, the system of this invention provides average insertion losses of about 6.95 dB at 2106 megahertz and about 7.87 dB at 2287 megahertz. Tables 1–4 demonstrate the performance of the system of this invention.

TABLE 1

| | SPD INSERTION LOSS CHARACTERISTICS WITH PURELY RESISTIVE LOADS (500) | | | |
|---|---|---|---|---|
| Selected Channels | Average Insertion Loss in dB f = 2106 MHz | Average Insertion Loss in dB f = 2287 MHz | Maximum Difference in Power Split in dB f = 2106 MHz | Maximum Difference in Power Split in dB f = 2287 MHz |
| 6, 15, 19, 20 | 7.28 | 8.08 | 1.00 | 1.30 |
| 7, 15, 19, 20 | 7.16 | 7.98 | 1.15 | 1.35 |
| 7, 12, 15, 20 | 7.25 | 8.06 | 0.80 | 1.00 |
| 7, 11, 12, 20 | 7.23 | 8.01 | 0.95 | 1.00 |
| 7, 12, 17, 20 | 7.25 | 8.04 | 0.62 | 0.60 |
| 7, 12, 17, 18 | 7.34 | 7.84 | 0.45 | 0.53 |

TABLE 1-continued

| SPD INSERTION LOSS CHARACTERISTICS WITH PURELY RESISTIVE LOADS (500) | | | | |
|---|---|---|---|---|
| Selected Channels | Average Insertion Loss in dB f = 2106 MHz | Average Insertion Loss in dB f = 2287 MHz | Maximum Difference in Power Split in dB f = 2106 MHz | Maximum Difference in Power Split in dB f = 2287 MHz |
| 7, 12, 17, 26 | 7.25 | 8.08 | 0.95 | 1.20 |
| 7, 17, 18, 27 | 7.50 | 8.24 | 0.18 | 0.40 |
| 12, 16, 17, 26 | 7.25 | 7.85 | 1.00 | 1.45 |
| 16, 17, 26, 27 | 7.62 | 8.11 | 0.70 | 1.05 |
| 16, 17, 18, 27 | 7.67 | 8.10 | 0.90 | 0.90 |
| 7, 13, 15, 18 | 7.56 | 7.88 | 0.80 | 0.70 |
| 15, 17, 18, 20 | 7.39 | 7.79 | 0.65 | 0.70 |
| Average Results for all Combinations | 7.37 | 8.00 | 0.78 | 0.94 |

TABLE 2

| THE MAXIMUM INSERTION PHASE DIFFERENCE BETWEEN CHANNELS FOR SELECTED GROUPS PURELY RESISTIVE LOADS (500) | | |
|---|---|---|
| Selected Channels | Maximum Phase Difference f = 2106 MHz | Maximum Phase Difference f = 2287 MHz |
| 6, 15, 19, 20 | 23.5° | 24.0° |
| 15, 17, 18, 20 | 12.9° | 14.5° |
| 7, 13, 15, 18 | 15.6° | 16.9° |
| 16, 17, 18, 27 | 18.8° | 20.4° |
| 16, 17, 26, 27 | 7.0° | 8.5° |
| 12, 16, 17, 26 | 19.5° | 21.4° |
| 7, 17, 18, 27 | 19.0° | 22.5° |
| 7, 12, 17, 26 | 8.5° | 9.0° |
| 7, 12, 17, 18 | 18.0° | 20.0° |
| 7, 12, 17, 20 | 11.1° | 13.0° |
| 7, 11, 12, 20 | 13.5° | 17.5° |
| 7, 12, 15, 20 | 10.0° | 12.3° |
| 7, 15, 19, 20 | 10.5° | 10.5° |
| Average Values | 14.5° | 16.2° |

TABLE 3

| SPD INSERTION LOSS CHARACTERISTICS WITH THE CIRCULARLY POLARIZED ELEMENTS AS LOADS | | | | |
|---|---|---|---|---|
| Selected Channels | Average Insertion Loss in dB f = 2106 MHz | Average Insertion Loss in dB f = 2287 MHz | Maximum Difference in Power Split in dB f = 2106 MHz | Maximum Difference in Power Split in dB f = 2287 MHz |
| 15, 17, 18, 20 | 6.76 | 7.71 | 0.30 | 0.85 |
| 7, 13, 15, 18 | 7.18 | 7.71 | 1.05 | 0.97 |
| 16, 17, 18, 27 | 7.05 | 7.76 | 0.33 | 1.10 |
| 16, 17, 26, 27 | 6.96 | 7.88 | 0.85 | 1.30 |
| 12, 16, 17, 26 | 6.59 | 7.94 | 0.65 | 2.05 |
| 7, 17, 18, 27 | 7.29 | 8.09 | 0.50 | 0.65 |
| 7, 12, 17, 18 | 6.94 | 7.65 | 0.70 | 0.65 |
| 7, 12, 17, 20 | 6.73 | 8.11 | 0.75 | 0.90 |
| 7, 11, 12, 20 | 6.93 | 8.09 | 0.65 | 1.60 |
| 7, 12, 15, 20 | 6.84 | 8.05 | 1.00 | 0.90 |
| 6, 15, 19, 20 | 7.10 | 7.69 | 1.00 | 2.10 |
| 7, 15, 19, 20 | 7.05 | 7.76 | 1.20 | 1.80 |
| Average Values | 6.95 | 7.87 | 0.75 | 1.24 |

TABLE 4

| THE MAXIMUM INSERTION PHASE DIFFERENCE BETWEEN CHANNELS FOR SELECTED GROUPS. CIRCULARLY POLARIZED ELEMENT LOADS | | |
|---|---|---|
| Selected Channels | Maximum Phase Difference f = 2106 MHz | Maximum Phase Difference f = MHz |
| 15, 17, 19, 20 | 11.0° | 13.0° |

TABLE 4-continued

| THE MAXIMUM INSERTION PHASE DIFFERENCE BETWEEN CHANNELS FOR SELECTED GROUPS. CIRCULARLY POLARIZED ELEMENT LOADS | | |
|---|---|---|
| Selected Channels | Maximum Phase Difference f = 2106 MHz | Maximum Phase Difference f = MHz |
| 7, 13, 15, 18 | 13.5° | 15.0° |
| 16, 17, 18, 27 | 15.0° | 21.0° |
| 16, 17, 26, 27 | 5.5° | 11.0° |
| 12, 16, 17, 26 | 19.5° | 18.5° |
| 7, 17, 18, 27 | 16.0° | 19.0° |
| 7, 12, 17, 26 | 11.5° | 11.0° |
| 7, 12, 17, 18 | 17.0° | 16.5° |
| 7, 12, 17, 20 | 10.0° | 11.0° |
| 7, 11, 12, 20 | 10.5° | 19.0° |
| 7, 12, 15, 20 | 6.5° | 13.5° |
| 7, 15, 19, 20 | 11.5° | 9.0° |
| 6, 15, 19, 20 | 23.0° | 25.0° |
| Average Values | 13.1° | 15.6° |

Tables 1 and 2 present the results of tests showing the insertion loss characteristics and phase difference between channels for selected groups of four inputs with a purely resistive load of 50 ohms. Tables 3 and 4 show the insertion loss characteristics and the phase differences between channels for select groups of four inputs with circularly polarized elements as loads.

From Tables 1 and 2, the average insertion losses of the system are 7.37 dB for 2106 megahertz and 8.00 for 2287 megahertz. The average maximum difference in power split between the outputs is 0.78 dB for 2106 megahertz and 0.94 dB at 2287 megahertz. From Table 2, it can be seen that the average insertion phase difference between channels was 14.5° at 2106 megahertz and 16.2° at 2287 megahertz.

The impact of more realistic VSWR loads on insertion loss and insertion phase differences is shown in Tables 3 and 4. When operating with such loads, the average insertion loss was reduced to 6.95 dB at 2106 megahertz and 7.87 dB at 2287 megahertz. The power split average difference was 0.75 at 2106 megahertz and 1.24 dB at 2287 megahertz. Average insertion phase differences into such loads are 13.1° at 2106 megahertz and 15.6° at 2287 megahertz.

Thus the system of this invention provides substantial improvements over prior systems. Although the tests of the invention were conducted with thirty-six inputs and with four of the thirty-six combined inputs operable, it should be understood that the N can be a larger or smaller number than thirty-six and M can be larger or smaller than four, with appropriate impedance-matching considerations being met. Furthermore, although the preferred embodiment of the invention employs microstrip techniques in the implementation of the system, other transmission line systems, such as coplanar, stripline, and coaxial cables, may be used in this invention. The invention is not, therefore, limited to the preferred embodiment shown, but should only be limited to the scope of the claims that follow.

We claim:

1. A system for switching a plurality of high-frequency signals applied thereto, comprising:

an alumina substrate with a surface having a single conductor disposed thereon to form a hub-like central portion and having a plurality of conductors disposed thereon to form a spoke-like array of N quarter-wave transformers, for said high-frequency signals, extending outwardly from inner ends adjacent the hub-like central portion of the single conductor, each of said N quarter-wave transformers having the same first characteristic impedance, said single conductor having an integral spoke-like portion extending outwardly from the hub-like central portion to form a single, integral quarter-wave transformer having a second characteristic impedance, said substrate carrying a plurality of N PIN diodes connected between the inner ends of said N quarter-wave transformers and the hub-like central portion of the single conductor; and connecting means carrying said alumina substrate, said connecting means comprising a Teflon printed wiring board having a plurality of N transmission lines thereon, each of the N transmission lines being connected at one of its ends with an associated one of the N quarter-wave transformers of the alumina substrate and at its opposite end with a high-frequency connection, said printed wiring board further having a single transmission line thereon connected at one of its ends with the single, integral quarter-wave transformer of the alumina substrate and at its opposite end with a high-frequency connection, said printed wiring board still further having a plurality of N bias quarter-wave transformers thereon, each of said N bias quarter-wave transformers being connected at one end with an associated one of the N transmission lines wherein the application of electrical potential to any M of the N bias quarter-wave transformers causes a current flow through the connected M of the N PIN diodes and causes a reduction of the electrical impedance of said M of the N PIN diodes so that high-frequency energy on said M of the N associated transmission lines can be transmitted through their associated M of the N quarter-wave transformers on the alumina substrate to the hub-like central portion of the single conductor for transmission over the single, integral, spoke-like quarter-wave transformer and the single transmission line of the printed wiring board.

2. A switching system for high-frequency energy applied thereto, comprising:

microstrip-switching means for providing an array of N quarter-wave transformers, N semiconductor switching means, and a single, common, quarter-wave transformer having one end associated with and connected to the N quarter-wave transformers by the N semiconductor-switching means, each of the N semiconductor-switching means being connected at one end with an associated one of the N quarter-wave transformers and being connected at the opposite end with said single, common quarter-wave transformer to permit the semiconductor-switching means to control the flow of high-frequency energy between the N quarter-wave transformers and the single, common, quarter-wave transformer; and microstrip-connecting means carrying said microstrip-switching means, said microstrip-connecting means comprising a printed wiring board having a plurality of N transmission lines thereon, each of the N transmission lines being connected at one end with an associated one of the N quarter-wave transformers of the microstrip-switching means and at the opposite end with a high-frequency connection, said printed wiring board further having a single transmission line connected at one end with the single, quarter-wave transformer of the microstrip-switching means and at the opposite end with a high-frequency connection, said printed wiring board further having a plurality of N bias quarter-wave transformers thereon, each of the N bias quarter-wave transformers being connected at one end with an associated one of the N transmission lines and at the opposite end with a source of control potential.

3. The switching system of claim 2 wherein the semiconductor-switching means comprises a plurality of PIN diodes.

4. The switching system of claim 2 wherein the microstrip-switching means comprises a disk-like alumina substrate, the N quarter-wave transformers form a spoke-like array arranged on the disk-like alumina substrate, the single common quarter-wave transformer includes a hub-like portion centrally located on the substrate and the spoke-like array of N quarter-wave transformers extends radially from inner ends of the N quarter-wave transformers located adjacent the hub-like central portion, the N semiconductor-switching means being connected between the hub-like central portion of the single common quarter-wave transformer and the inner end of an associated one of the N quarter-wave transformers.

5. The switching system of claim 4 wherein the microstrip-connecting means comprises a Teflon printed wiring board surrounding the microstrip-switching means, the N transmission lines form a spoke-like array arranged about the microstrip-connecting means and generally surrounding the microstrip-switching means, and the N bias quarter-wave transformers also form a spoke-like array arranged about the microstrip-connecting means and generally surrounding the microstrip-switching means, each of said N-bias quarter-wave transformers being located generally adjacent and parallel to its associated transmission line and connected with its associated transmission line adjacent the microstrip-switching means.

6. The switching system of claim 4 further comprising an interconnecting ring between the printed wiring board and the alumina substrate, said interconnecting ring providing N connections to carry electrical energy from each of the N-bias quarter-wave transformers and each of the N transmission lines of the printed wiring board to each of the N quarter-wave transformers and each of the N PIN diodes of the alumina substrate.

7. The switching system of claim 6 further comprising a brass ring between the Teflon printed wiring board and the interconnecting ring which carries N feedthroughs between the printed wiring board and the interconnecting ring, one for providing each of the connections between the N transmission lines and the associated N connections of the interconnecting ring.

8. A radio-frequency switching system for RF energy applied thereto, comprising:

a dielectric substrate having an plurality of conductors on its surfaces to form an array of N quarter-wave transformers for radio-frequency signals, each of said N quarter-wave transformers having a first characteristic impedance and terminating at one end, thereby forming part of an array of adjacent ends of said N quarter-wave transformers, said substrate further having a single conductor on its surface to form an enlarged portion adjacent to the array of adjacent ends of said N quarter-wave transformers and an integral portion extending outwardly from the enlarged portion to form a quarter-wave transformer having a second characteristic impedance different than said first characteristic impedance, said substrate carrying a plurality of semiconductor switches connecting each one of the arrayed ends of said N quarter-wave transformers to the enlarged portion of the single conductor; and connecting means carrying said dielectric substrate, said connecting means comprising a printed wiring board having a plurality of N transmission lines thereon, each of the N transmission lines being connected at one end with an associated one of the N quarter-wave transformers of the dielectric substrate and at the opposite end with a radio frequency connection, said printed wiring board further having a single transmission line thereon connected at one end with the single, integral quarter-wave transformer of the dielectric substrate and at the opposite end with a radio frequency connection, said printed wiring board still further having a plurality of N bias quarter-wave transformers thereon, each of the N bias quarter-wave transformers being connected at one end with an associated one of the semiconductor switches wherein the application of electrical potential to any M of the N bias quarter-wave transformers reduces the electrical impedance of the associated M of the N semiconductor switches so that the RF energy can be transmitted through the M of the N associated transmission lines, the M of the N quarter-wave transformers on the dielectric substrate, the enlarged portion of the single conductor, the single, integral quarter-wave transformer of the substrate, and the single transmission line of the printed wiring board.

9. A switching system for high-frequency energy applied thereto, comprising:

microstrip-switching means comprising a disk-like alumina substrate having an array of N quarter-wave transformers disposed thereon in a spoke-like array, and a single, quarter-wave transformer including a hub-like portion centrally located on the substrate, said N quarter-wave transformers extending outwardly from inner ends adjacent the hub-like portion of the single quarter-wave transformer, said single, quarter-wave transformer being connected to the N quarter-wave transformers by N PIN diodes connected between the inner ends of each of the N quarter-wave transformers and the hub-like portion of the single, quarter-wave transformer; and microstrip-connecting means comprising a Teflon printed wiring board surrounding the microstrip-switching means and having formed thereon a plurality of N transmission lines in a spoke-like array arranged about the microstrip-connecting means and generally surrounding the microstrip-switching means, each of the N transmission lines being connected at one end with an associated one of the N quarter-wave transformers of the microstrip-switching means and at the opposite end with an HF connection, said printed wiring board also having a single transmission line thereon connected at one end with the single, quarter-wave transformer of the microstrip-switching means and at the opposite end with an HF connection, said printed wiring board further having a plurality of N bias quarter-wave transformers thereon, each of the N bias quarter-wave transformers being connected at one end with an associated one of the N transmission lines and at the opposite end with a source of control potential, each of the N bias quarter-wave transformers being located generally adjacent and parallel to its associated transmission line and connected with its associated transmission line adjacent the microstrip-switching means.

10. A switching system for high-frequency energy applied thereto, comprising:

a disk-like microstrip substrate with an array of N microstrip quarter-wave transformers disposed thereon in a spoke-like array to form N impedance-matching devices, and with a single microstrip quarter-wave transformer to form a single impedance-matching device including a hub-like portion that is located within inner ends of the spoke-like array of N quarter-wave transformers, N PIN diodes connected between each inner end of each of the N quarter-wave transformers and the hub-like portion to control the flow of high-frequency energy between the N impedance-matching devices and the single impedance matching device, and a microstrip printed wiring board surrounding the disk-like microstrip substrate and having N transmission lines thereon arranged in a spoke-like array and generally surrounding the disk-like microstrip substrate, each of said N transmission lines being connected with an associated one of the N microstrip quarter-wave transformers adjacent the disk-like microstrip substrate, said microstrip printed wiring board also having a single transmission line thereon connected at one end with the single microstrip quarter-wave transformer and at the opposite end with an HF connection, said microstrip printed wiring board further having N bias quarter-wave transformers thereon arranged in a spoke-like array about the microstrip printed wiring board and generally surrounding the disk-like microstrip substrate, each of the N bias quarter-wave transformers being connected at one end with an associated one of the N transmission lines and at the opposite end with a source of control potential and being located generally adjacent and parallel to its associated transmission line, the application of control potential to said N bias microstrip quarter-wave transformers controlling the impedance of the N PIN diodes and the flow of high-frequency energy through the disk-like microstrip substrate.

* * * * *